United States Patent [19]

Hoshino

[11] Patent Number: 4,570,526

[45] Date of Patent: Feb. 18, 1986

[54] TENSIONING DEVICE FOR A DRUM HEAD

[75] Inventor: Yoshihiro Hoshino, Nagoya, Japan

[73] Assignee: Hoshino Gakki Co., Ltd., Japan

[21] Appl. No.: 673,530

[22] Filed: Nov. 21, 1984

[30] Foreign Application Priority Data

Apr. 20, 1984 [JP] Japan ..... 59-58853

[51] Int. Cl.[4] ..... G10D 13/02

[52] U.S. Cl. ..... 84/413; 84/411 R

[58] Field of Search ..... 84/411–420

[56] References Cited

U.S. PATENT DOCUMENTS

| | | | |
|---|---|---|---|
| 1,077,347 | 11/1913 | Hoskins | 84/411 R |
| 1,561,789 | 11/1925 | Ludwig et al. | 84/419 |
| 2,132,105 | 10/1938 | Gladstone | 84/411 R |
| 2,172,578 | 9/1939 | Gladstone | 84/411 R |
| 3,163,076 | 12/1964 | White | 84/419 |
| 4,373,419 | 2/1983 | Tuttrup | 84/411 R |
| 4,506,586 | 3/1985 | Brewer | 84/413 |

*Primary Examiner*—Lawrence R. Franklin

*Attorney, Agent, or Firm*—Ostrolenk, Faber, Gerb & Soffen

[57] ABSTRACT

A tensioning apparatus for adjusting the tension of the bottom head of a drum, by acting at the top of the drum. A movable element pivots up and down on the body of the drum. A bolt, which engages the bottom drum head tightening hoop of the drum, is threadedly connected to a pin which is anchored at the lower jaw of the movable element. A threaded rod, connected to the upper jaw of the movable element, extends upwardly. The connection to the threaded rod is further from the pivot pin of the movable element than is the connection to the pin for the bolt. An adjustment nut with a threaded bore receives the threaded rod and the nut extends to the top of the drum. A coarse tension adjustment in the bottom drum head is set with the bolt, and a fine adjustment is set by rotating the nut at the top of the drum.

14 Claims, 4 Drawing Figures

TENSIONING DEVICE FOR A DRUM HEAD

BACKGROUND OF THE INVENTION

The present invention relates to a musical drum and more particularly to a drum head tensioning device for adjusting the tension of the bottom drum head.

A musical instrument drum includes a body, typically in the form of a cylinder, with bottom and top openings. The bottom and top openings are covered by respective drum heads for defining a resonant cavity inside the body. Each drum head includes a vibratory membrane which is stretched across the respective opening and includes a tightening hoop which surrounds the outer periphery of the opening and bears on an overhanging portion of the membrane as to secure the membrane over the opening and to increase the tension in the membrane as the tightening hoop is urged toward the body of the drum.

In known drums of this type, a series of upper and lower tightening bolts or screws are provided around the body of the drum for connecting the respective upper and lower tightening hoops to the drum body and for adjusting the tension of the respective membranes by adjusting the pressure of the tightening hoops on the membranes.

The sound produced by a drum is affected by the interaction of the vibrations from the bottom and top drum head membranes. Accordingly, it is often necessary to adjust the tension in the bottom and top drum heads by tightening or loosening their respective upper and lower bolts. This tension adjustment procedure can be cumbersome and time consuming. This is a result of the necessity to strike the top membrane and to repeatedly adjust the tension in the bottom and top drum head membranes until a satisfactory sound is produced. The inconvenience of having to reach to the lower bolts at the bottom of the mounted drum is apparent.

SUMMARY OF THE INVENTION

Accordingly, it is an object of the present invention to provide a top side accessible tensioning device for adjusting the tension of a bottom drum head membrane.

It is another object of the invention to provide a tensioning device which includes a first tension adjusting mechanism for a coarse tension setting of the bottom drum membrane and a second tension adjusting mechanism which is accessible at the top of the drum to provide a fine tension adjustment for the bottom drum head membrane.

It is a further object of the invention to provide a bottom drum head membrane tensioning device including an adjusting element which is positioned at the top of the drum, perhaps near a respective adjusting mechanism for adjusting the tension in the top drum membrane.

The foregoing and other objects are realized with the drum head tensioning device according to the present invention. The device includes a movable element which is pivotally secured at the drum body and is vertically swingable around its pivotable securement toward and away from the bottom drum head.

First tensioning means connect the bottom drum head to the movable element such that tightening the first tensioning means draws the movable element and the bottom drum head together for tensioning the bottom drum head membrane, and loosening the first tensioning means reduces the tension on the bottom drum head.

Second tensioning means extend from the movable element toward the top of the drum such that tightening of the second tensioning means draws the movable element toward the top of the drum to increase the tension on the bottom drum head membrane and loosening the second tensioning means reduces the tension on the bottom drum head. The first and second tensioning means can be operated in opposition or additively.

Bottom drum head tension is simple to adjust. A first coarse tension adjustment is made with the first tensioning means located at the bottom of the drum, as in the prior art. Thereafter, fine tuning of the drum sound is accomplished both by adjusting the tension of the upper drum head at the top of the drum in the conventional way, and if further adjustment of the tension of the bottom drum head is also required, the second tensioning means, which are also operable from the top of the drum, is adjusted.

The above mentioned movable element is a swingable two jaw, forked element. The movable element includes a main body which lies in a generally vertical plane and is supported on a pivot pin which extends transversely to the drum body and which connects the movable element to a support on the outside of the drum body. In this manner, the movable element is swingable in a vertical plane. Upper and lower jaws of the movable element extend in a direction away from the trunk wall.

In one embodiment, the first tensioning means which attaches the bottom drum head to the movable element is anchored between the two jaws. Tightening of the first tensioning means pulls the bottom hoop of the bottom drum head toward the movable element and pulls the movable element to swing toward the bottom hoop. In particular, the first tensioning means includes an elongate threaded bolt which is attached to the tightening hoop of the bottom drum head. The threaded shank of the bolt passes through a threaded hole in a generally horizontally disposed securing pin which is received between the jaws of the movable element. Tightening the bolt draws the securing pin and thereby pulls the tightening hoop and the movable element together.

Fine tuning of the bottom drum head tension is done by the second tensioning means which includes a rod which is anchored to the upper, laterally protruding jaw of the movable element. The rod is also supported on the body of the drum. Means on the rod operate against the support to shift the rod to further increase the tension on the bottom drum head. A connection between the rod and the movable element causes the rod to act upon the movable element for adjusting the tension on the bottom drum head. In particular, the rod is threaded and receives a threaded nut which is rotatable but held from shifting by the support, whereby rotation of the nut from the top of the drum moves the rod to shift the movable element.

The rod of the second tensioning means is anchored in the upper jaw of the movable element. The bolt of the first tensioning means is anchored between the upper and lower jaws. The rod is anchored to the movable element further from the pivot pin than is the bolt. This provides a greater lever arm for tension adjustments with the second tensioning means.

In accordance with the present invention, satisfactory tension adjustment of the lower drum membrane is achievable when the movable element is swingable through 40° of arc centered about an imaginary plane which passes through the pivot pin of the movable element and which is perpendicular to the trunk wall.

Other features and advantages of the invention will be apparent from the following description of a preferred embodiment of the invention considered with reference to the accompanying drawings.

DESCRIPTION OF THE PREFERRED EMBODIMENT

Figures 1, 2:
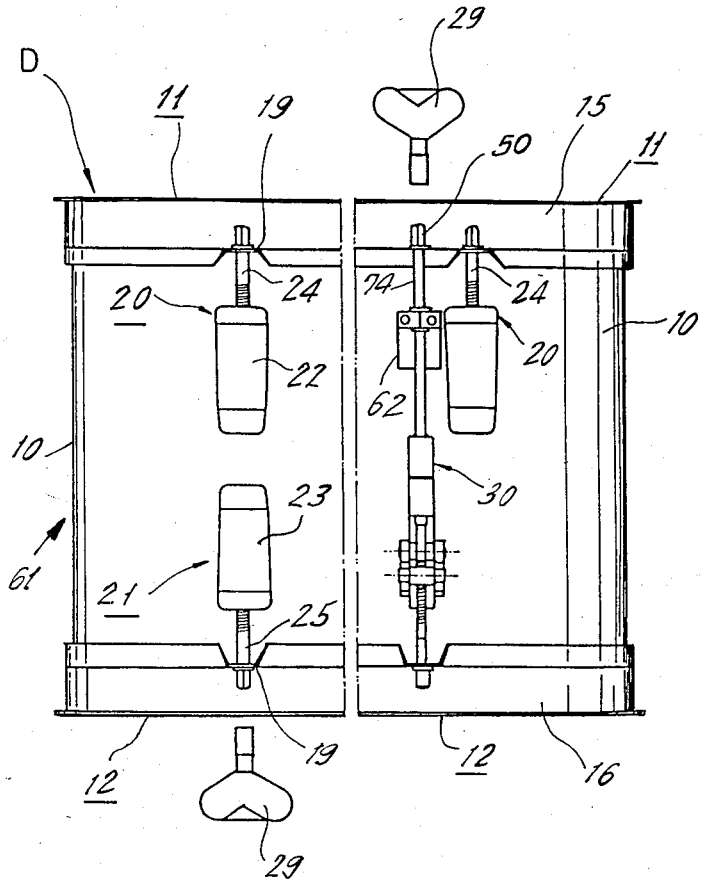
FIG. 1. (PRIOR ART) FIG. 2.
FIG. 1 is an elevational view showing prior art means for adjusting the tension in the bottom and top drum heads of a drum.
FIG. 2 is an elevational front view of a tension adjusting mechanism which replaces the prior art bottom drum head tension adjusting means of FIG. 1.
Figure 4:
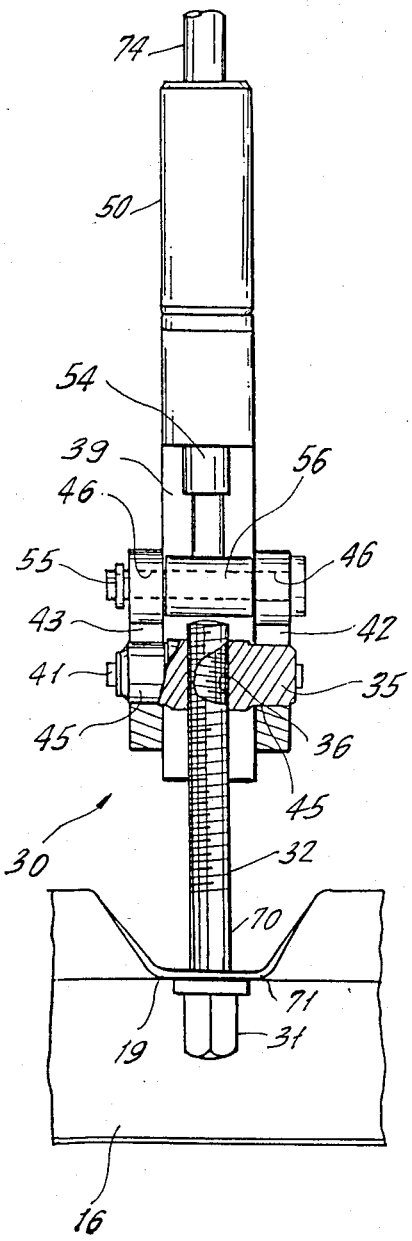
FIG. 4 is an elevational front view of the tension adjusting mechanism of FIG. 2.

FIG. 1 shows a drum provided with prior art mechanisms used for adjusting the tension of the bottom and the tension of the top drum head membranes. The drum D includes a body 10 comprising a hollow cylinder with top and bottom openings which are covered, respectively, by a top drum head 11 and a bottom drum head 12.

Figure 3:
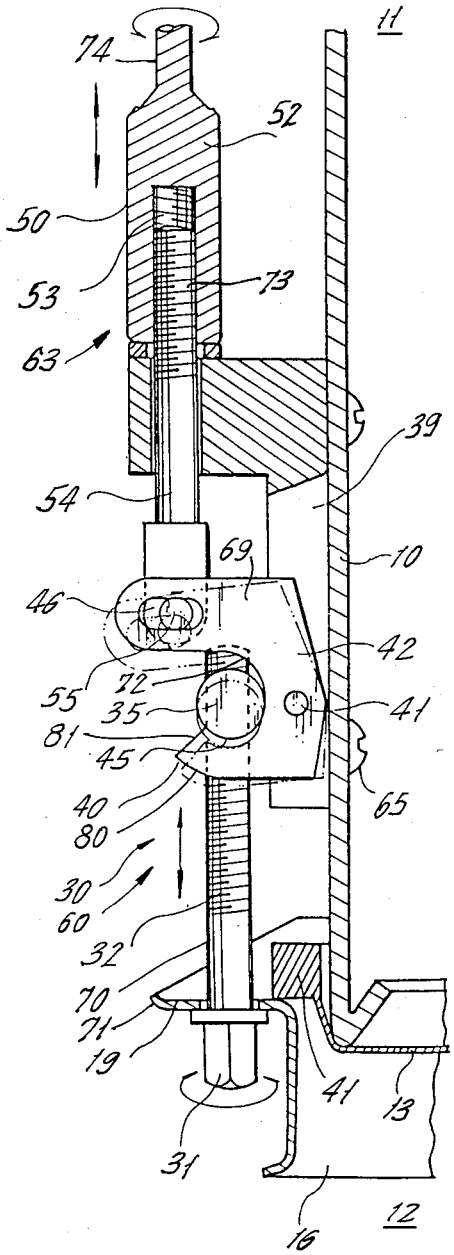
FIG. 3 is an elevational side view showing in greater detail the tension adjusting mechanism of FIG. 2.

Referring to FIG. 3, a drum head includes a circular stretchable membrane 13 having an area sufficient to cover the respective top or bottom opening in the drum and includes a circumferential edge ring 14 fastened to the periphery of the membrane. A tensioning hoop 16 having an outwardly bent jaw part 19 bears against the edge ring 14 to control the tension in the drum head membrane.

Referring to prior art FIG. 1, the top drum head tension adjusting mechanism 20 includes a stationary anchoring structure 22 which is secured to the wall of the drum body. A bolt 24 passes through the top drum head tensioning hoop 15 of the drum head and is received in the anchoring structure 22. Turning the bolt 24 in one direction or the other adjusts the tension on the membrane of the top drum head 11.

The tension adjusting mechanism 21 of the prior art for the bottom drum head 12 is identical to that for the top drum head, except that it is at the bottom of the drum. The mechanism 21 includes an anchoring structure 23, a bolt 25 and a tension adjusting bolt head 31. To adjust the tension on the membrane of the bottom drum head 12, the musician must reach to the bottom of the drum and emplace a rotation key 29 over the bolt head 31 and rotate the bolt. As a typical drum includes a plurality of tension adjusting mechanisms which are spaced around the top and bottom peripheries of the drum body 10, and because a drum, and more typically a few of them, are supported on a stand, tension adjustment of the top and bottom drum heads of all of the drums is difficult, especially as access to the bottoms of the drums is blocked or requires complicated manipulations. The overall sound of a drum is affected by an interplay in the tensions in the top and bottom drum head membranes. Consequently, in tuning the musical instrument, the musician must repeatedly strike the membrane of the top drum head while adjusting the top and bottom tension adjusting mechanisms until a satisfactory sound is obtained. Easy access to all adjusting mechanisms is desirable.

In accordance with the invention, the task of tuning the drum is greatly facilitated by substituting for the prior art bottom drum head tension adjusting mechanism 21 the tension adjusting mechanism 30 of the invention. The primary bennefit of the invention is that adjustment of the tension in the lower drum head is performed from above at the top of the drum.

The tensioning mechanism 30 includes a movable element 40 which is pivotally attached to the drum body 10, the coarse tension adjusting mechanism 60 which connects the lower drum head tightening hoop 16 to the movable element 40, and the fine tension adjusting mechanism 63 which is also attached to the movable element 40.

Base support 39 is connected to the drum body wall by screws 65 and 66. The movable element 40 is pivotally connected to the support base 39 by pin 41. The movable element 40 includes a pair of movable plates 42, 43 which are positioned on opposite sides of the base 39 and move together as one unit. Each of the plates 42, 43 includes a lower jaw 80 which extends away from the drum body 61 and includes an end 81 which curves slightly upwardly to capture the below described pin 35. Above the lower jaw 80, there is an upper jaw 69 which also extends away from the wall of the drum body 10. The upper jaw 69 is longer than the lower jaw 80. A groove 46 is defined in the upper jaw 69 in each of the plates 42 and 43 toward their outer ends.

The coarse tension adjusting mechanism includes a tensioning means in the form of a bolt 70 with a tool engagable head 31 which is above a wider flange portion 71 that seats against the drum head hoop 19. The bolt has a threaded upper section 32 for reception in the below described securing pin 35.

The securing pin 35 extends transversely to the bolt 70 and extends between the plates 42, 43. The pin 35 includes a threaded bore 36 across it for threadedly receiving the bolt 70. The pin 35 sits against the web of the notch 72 between the upper jaw 69 and the lower jaw 80. By tightening the bolt 70 into the pin bore 36, the securing pin 35 draws the tightening hoop 16 toward the movable element 40 and stretches the membrane 13 by pressing down upon the edge ring 14.

To both limit the angular rotation of the movable element 40 and to fine tune the tension on the lower membrane 13, the fine tension adjusting mechanism 63, which is accessible from the top of the drum, is provided. It comprises a rod 54, with a threaded upper section 73 that passes upward through the base 39. The bottom of the rod 54 is attached to a transverse hollow cylindrical head 56. The hollow cylidrical head is positioned between the movable element plates 42 and 43. A connective pin 55 passes through the head 56 and into the elongate grooves 46 defined in the upper jaws of the plates 42, 43. In this manner, the rod 54 is anchored to the movable element 40. The location of the grooves 46 is further out from the pin 41 and the body 10 than the pin 35 for a larger lever arm at the upper jaw.

The threaded section 73 of the rod 54, which protrudes beyond the top of the support 39, receives over it a long adjusting nut 52 that is internally threaded at 53. The nut 52 seats upon the base 39 so that when the tightening bolt 31 is turned, the movable element 40 is restrained from pivoting excessively. Furthermore, turning the adjustment nut 52 moves the upper jaw part 69 and acts against the coarse tensioning means 30 to adjust the tension on the lower drum head membrane 13.

As seen in FIG. 3, the adjusting nut 52 includes a long stem 74 which reaches the top of the drum at the head 50. The stem 74 is held in by a guide 62 on the drum body.

The operation of the tightening and securing mechanism 30 is now described. The bolt 31 at the bottom of the drum is tightened approximately to the required tension level in the bottom drum head membrane 13. Thereafter, while the musician is playing the instrument by beating upon the top drum head, a further adjustment is made in the tension of the lower drum head membrane 13 from the top of the drum with key 29. At the same time and, most important, from the same top side of the drum, the upper drum head tension adjustment means 20 is also adjusted so that the interacting drum heads are adjusted to produce the desired sound.

Furthermore, with the present invention, wherein the upper jaw part 69 is longer than the lower jaw part 80, the groove 46 and the pin 55 travels over a greater arc than the pin 35. In this manner, control over the orientation of the movable element is assured by the rod 54, which can override the bolt 31. This provides more accurate control over drum head tension.

Although the present invention has been described in connection with preferred embodiments thereof, many variations and modifications will now become apparent to those skilled in the art. It is preferred, therefore, that the present invention be limited not by the specific disclosure herein, but only by the appended claims.

What is claimed is:

1. A drum head tensioning apparatus for a musical instrument drum, the drum having a hollow body enclosed by a peripheral wall and having a top and a bottom axial opening which are covered by respective top and bottom drum heads, the drum heads including respective top and bottom sound membranes, the apparatus comprising:

a movable element pivotally secured to the drum body and vertically swingable between a lower position tilted more toward the lower drum head and an upper position tilted more toward the upper drum head;

first tensioning means for adjusting the tension on the bottom drum head membrane, the first tensioning means extending from the bottom drum head and being anchored to the movable element such that tightening the first tensioning means pulls the movable element toward the lower position and also increases the tension on the bottom membrane; and second tensioning means also anchored to the movable element and having an end extending toward the top drum head; means located toward the end of the second tensioning means operable for moving the movable element with respect to the motion caused by the first tensioning means for further adjusting the tension of the bottom drum head membrane.

2. The apparatus of claim 1 further comprising a horizontally oriented pivot pin on the drum body for pivotable securement of the movable element.

3. The apparatus of claim 2, wherein the first tensioning means engages the movable element closer to the pivot pin, while the second tensioning means engages the movable element further from the pivot pin.

4. The apparatus of claim 2, wherein the movable element comprises a lower jaw extending away from the drum body and an upper jaw located above the lower jaw, the first tensioning means being anchored to the movable element at the lower jaw, the second tensioning means being anchored to the movable element at the upper jaw.

5. The apparatus of claim 4, wherein the first tensioning means engages the movable element closer to the pivot pin, while the second tensioning means engages the movable element further from the pivot pin.

6. The apparatus of claim 5, wherein the first tensioning means engages the movable element between the upper and lower jaws while the second tensioning means engages the movable element at the upper jaw.

7. The apparatus of claim 4, wherein the first tensioning means includes a rotatable bolt which engages the bottom drum head, a threaded shank on the bolt, and a generally horizontally extending securing pin with a threaded bore defined therein for receiving the threaded shank of the bolt; the securing pin being anchored on the movable element, whereby rotation of the bolt moves it in the pin to bias the movable element to move.

8. The apparatus of claim 7, wherein the upper jaw has a groove defined in it for engaging the second tensioning means, and wherein the second tensioning means includes a second securing pin extending into the groove;

the second tensioning means further including a non-rotating rod supported from the second pin, a second threaded shank on the rod; a rotatable nut threadedly receiving the threaded rod, the nut being supported to the drum body such that rotation of the nut causes the rod to bias the movable element to move.

9. The apparatus of claim 8, wherein the first mentioned securing pin engages the movable element between the upper and lower jaws while the second securing pin engages the movable element at the upper jaw.

10. The apparatus of claim 2, wherein the second tensioning means comprises a non-rotating rod anchored to the movable element, a threaded shank on the rod; a rotatable nut threadedly receiving the threaded rod, the nut being supported to the drum body such that rotation of the nut causes the rod to bias the movable element to move.

11. The apparatus of claim 10, wherein the first tensioning means includes a rotatable bolt which engages the bottom drum head, a second threaded shank on the bolt and internally threaded means on the movable elemment for receiving the second threaded shank of the bolt, whereby rotation of the bolt moves it to bias the movable element to move.

12. The apparatus of claim 2, wherein the first tensioning means includes a rotatable bolt which engages the bottom drum head, a threaded shank on the bolt and internally threaded means on the movable element for receiving the threaded shank of the bolt, whereby rotation of the bolt moves it to bias the movable element to move.

13. The apparatus of claim 2, wherein the drum further includes means for adjusting the tension in the top drum head membrane.

14. The apparatus of claim 13, wherein the first tensioning means is positioned adjacent the means for adjusting the tension in the top drum head.

* * * * *